US011945482B2

(12) United States Patent
Gawne

(10) Patent No.: US 11,945,482 B2
(45) Date of Patent: Apr. 2, 2024

(54) SYSTEM FOR COMMUNICATING VEHICLE INFORMATION

(71) Applicant: Westinghouse Air Brake Technologies Corporation, Pittsburgh, PA (US)

(72) Inventor: Kendrick W. Gawne, Cedar Rapids, IA (US)

(73) Assignee: WESTINGHOUSE AIR BRAKE TECHNOLOGIES CORPORATION, Pittsburgh, PA (US)

( * ) Notice: Subject to any disclaimer, the term of this patent is extended or adjusted under 35 U.S.C. 154(b) by 351 days.

(21) Appl. No.: 17/226,077

(22) Filed: Apr. 9, 2021

(65) Prior Publication Data

US 2021/0323592 A1 Oct. 21, 2021

Related U.S. Application Data

(60) Provisional application No. 63/011,758, filed on Apr. 17, 2020.

(51) Int. Cl.
*B61L 25/04* (2006.01)

(52) U.S. Cl.
CPC ..... *B61L 25/04* (2013.01)

(58) Field of Classification Search
CPC ..... B61L 25/04; B61L 1/185; B61L 1/187; B61L 3/20; B61L 25/025; B61L 1/188
See application file for complete search history.

(56) References Cited

U.S. PATENT DOCUMENTS

| | | | | |
|---|---|---|---|---|
| 10,757,671 | B2 * | 8/2020 | Millman | G01S 5/02525 |
| 2013/0090801 | A1 * | 4/2013 | Backes | B61L 23/28 701/23 |
| 2015/0025716 | A1 * | 1/2015 | Orion | B61L 3/12 701/19 |
| 2016/0054250 | A1 * | 2/2016 | Kumar | G01N 27/20 324/693 |

* cited by examiner

*Primary Examiner* — Peter D Nolan
*Assistant Examiner* — Demetra R Smith-Stewart
(74) *Attorney, Agent, or Firm* — The Small Patent Law Group LLC; Philip S. Hof

(57) ABSTRACT

A system that may include a first route circuit that may be configured to be coupled with a first route section and may be configured to generate a first location coded signal that is unique to the first route section responsive to a vehicle being located on or within the first route section. A second route circuit may be configured to be coupled with a second route section and configured to generate a second location coded signal that is unique to the second route section and that is different from the first location coded signal, the second route circuit configured to generate the second location coded signal responsive to the vehicle being located on or within the second route section. A controller may be configured to receive the first location coded signal and the second location coded signal and determine a location of the vehicle based on the first location coded signal or the second location coded signal.

20 Claims, 3 Drawing Sheets

SYSTEM FOR COMMUNICATING VEHICLE INFORMATION

CROSS REFERENCE TO RELATED APPLICATIONS

This application claims priority to U.S. Provisional Patent Application No. 63/011,758, entitled SYSTEM FOR COMMUNICATING VEHICLE INFORMATION, which was filed on 17 Apr. 2020, and the entire disclosure of which is incorporated herein by reference.

BACKGROUND

Technical Field

The subject matter described relates to systems and methods that communicate information related to a vehicle on a route.

Discussion of Art

Many vehicles travel on determined routes. For example, rail vehicles travel along tracks that may include different sections. Knowing the location of a vehicle along a route typically is important to assist third parties in preventing vehicles from colliding. For example, in a rail vehicle example, a remote dispatcher may monitor global positioning system (GPS) signals and communicate with engineers of different trains to prevent collisions, and trains taking the same track.

For vehicles monitored by GPS, problems can occur with tracking based on limitations of the GPS to monitor a vehicle in all locations. For example, when a vehicle goes within a tunnel, a GPS receiver may not be able to detect a GPS signal. Additionally, in some open areas, GPS signals may not be as strong and consistent as in other areas. Similarly, sometimes signal reading can be wrong, indicating a vehicle is located somewhere different than where the vehicle is actually located. Thus, advancements in vehicle monitoring along routes is desired.

BRIEF DESCRIPTION

In one or more embodiments, a system may be provided that may include a first route circuit configured to be coupled with a first route section and configured to generate a first location coded signal that is unique to the first route section responsive to a vehicle being located on or within the first route section. The system may also include a second route circuit configured to be coupled with a second route section and configured to generate a second location coded signal that is unique to the second route section and that is different from the first location coded signal, the second route circuit configured to generate the second location coded signal responsive to the vehicle being located on or within the second route section. The system may also have a controller configured to receive the first location coded signal and the second location coded signal and determine a location of the vehicle based on the first location coded signal or the second location coded signal.

In one or more embodiments, a controller may be provided that may include one or more processors that may be configured to receive a first location coded signal from a first route circuit when a vehicle is on a first route section. The first location coded signal may be unique to the first route section. The one or more processors may also be configured to receive a second location coded signal from a second route circuit when the vehicle is on a second route section, the second location coded signal unique to the second route section, and determine a location of the vehicle based on the first location coded signal or on the second location coded signal.

In one or more embodiments a system may be provided that may include a first route circuit that may be configured to be coupled with a first route section and configured to generate a first location coded signal that is unique to the first route section responsive to a vehicle being located on or within the first route section. The system may also include a second route circuit that may be configured to be coupled with a second route section and configured to generate a second location coded signal that is unique to the second route section and that is different from the first location coded signal, the second route circuit configured to generate the second location coded signal responsive to the vehicle being located on or within the second route section. The system may also include a third route circuit that may be configured to be coupled with a third route section and may also be configured to generate a third location coded signal that may be unique to the third route section and that may be different from the first location coded signal. The third route circuit may also be configured to generate the third location coded signal responsive to the vehicle being located on or within the third route section. The system may also include a controller that may be configured to receive the first location coded signal, the second location coded signal, and the third location coded signal and determine a position of a switch adjacent the first route section based on at least one of the first location coded signal, the second location coded signal, or the third location coded signal.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to systems that use route circuits to provide coded signals that are unique to individual sections of a route to provide location information related to the vehicle. By using route circuits that are completed when a vehicle is on or within that route section, a location coded signal may be generated in locations that global positioning systems (GPSs) cannot reach. The coded signal may be coded by providing differing current pulse rates unique that section of a route along a first frequency. Additional, or auxiliary information about the vehicle may still be provided by the route circuit by using a second frequency. Then, a controller may be configured to receive coded signals to determine the location of the vehicle based on the location coded signal received. For rail based vehicles, the controller may determine a track section where the rail vehicle is located, the position of a switch along a track section, and similar information based on the location coded signals received.

Figure 1:
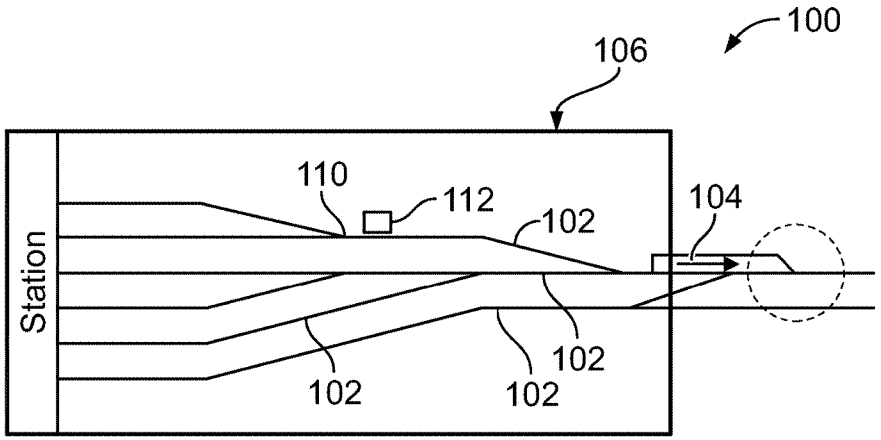
FIG. 1 illustrates a schematic diagram of a vehicle system.

FIG. 1 illustrates a vehicle system 100 that includes a series of routes 102 along which a vehicle 104 may travel. In this example, the series of routes represent tracks upon which a rail vehicle travels. While a rail vehicle is illustrated, in other examples over the road vehicles, utility vehicles, off-road vehicles, or the like may be provided. Specifically, any application that may include a determined route, highway, roadway, pathway, or the like that may include a route circuit may be presented. A route circuit as used herein may include any combination of electronic devices that may be completed by a vehicle to send signals to a controller.

As illustrated by FIG. 1, the series of routes may include a tunnel or station 106 that may be enclosed. The one or more routes may split at determined intersections 110 where a switching device 112 may be provided adjacent the route to determine which route a vehicle travels. The station may house the vehicle, be a location for taking a different route, loading or unloading, or the like. In example embodiments, the station may be within an enclosure to protect the vehicles from the environment. Specifically, in certain locations along the route such as within the tunnel, and within the enclosure of the station, signals such as GPS signals may be difficult to receive. Even if received, the exact location of a vehicle may not be determined, especially within the station where numerous different sections of track are provided within the enclosed area.

Figure 2:
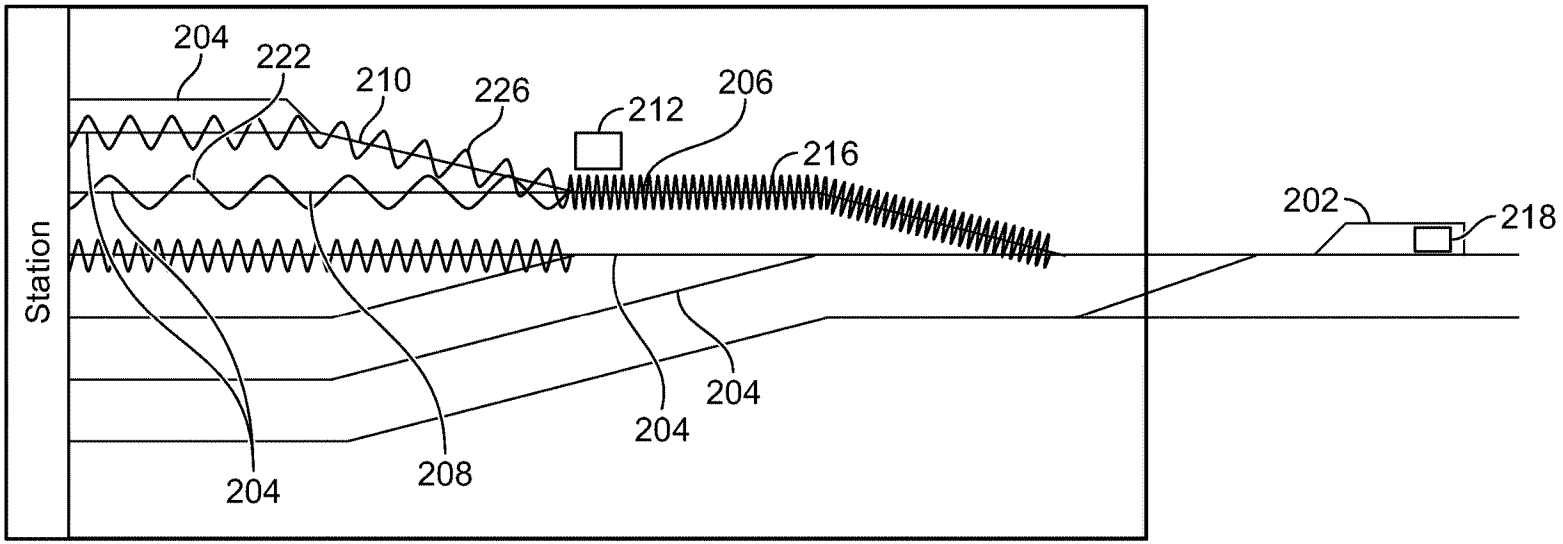
FIG. 2 illustrates a schematic diagram of a system for communicating information related to a vehicle.

FIG. 2 illustrates a schematic diagram of a system 200 for communicating information related to a vehicle 202 that may travel along one or more routes 204. In one example, the vehicle and routes of FIG. 2 may be the vehicle and routes illustrated and described in FIG. 1. In the example of FIG. 2, a first route 206 is provided that may be coupled to a second route 208 that is aligned with the first route, and coupled to a third route 210 transverse to the first route. A switch 212 may be provided adjacent and/or between the second route and third route and operable to switch the coupling of the first route between the second route and third route.

Figure 3:
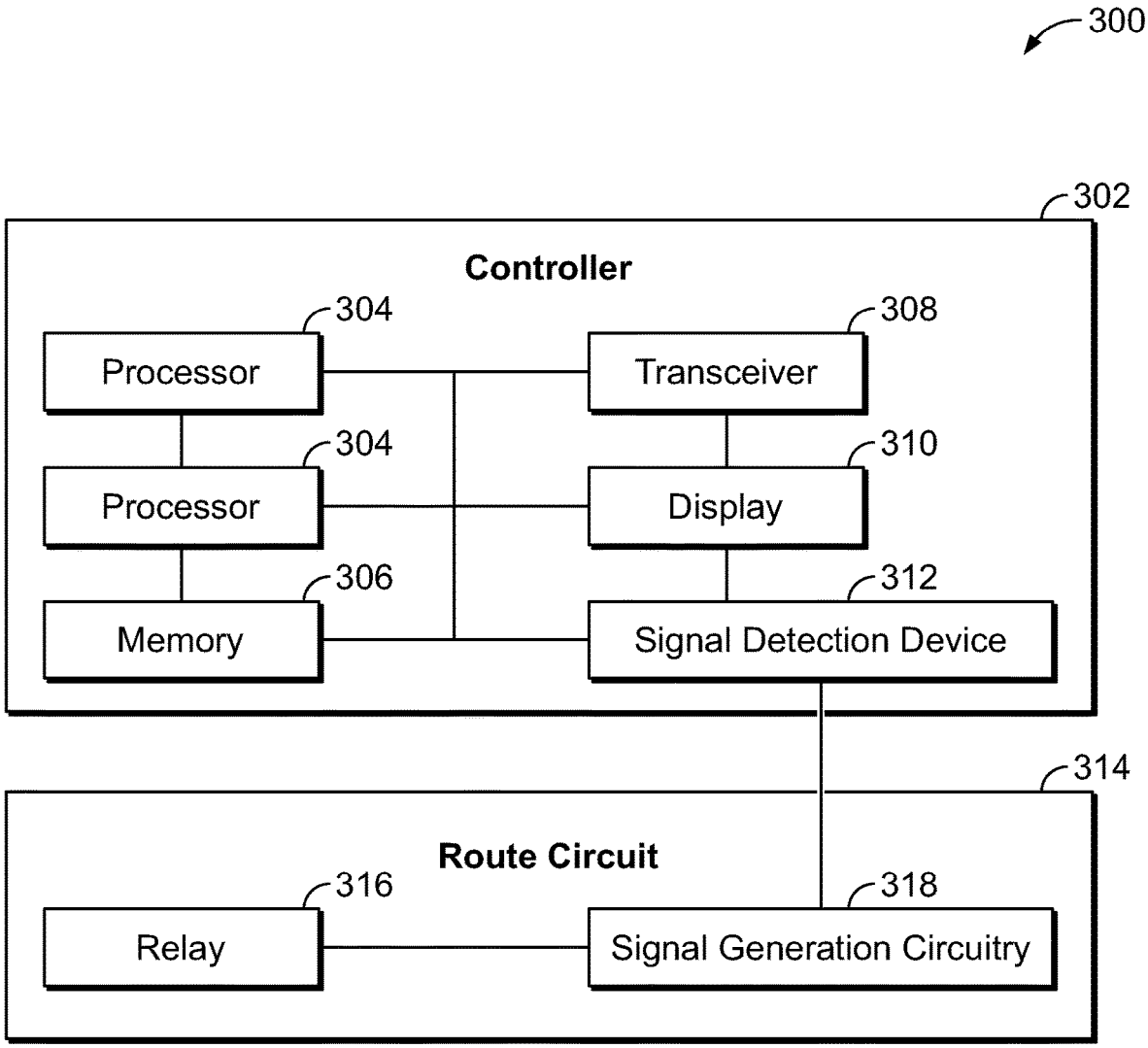
FIG. 3 illustrates a schematic diagram of a control system.

The first route may include a first route circuit (FIG. 3). The first route circuit may include electrical components to provide a first coded location signal 216 that may be received by a vehicle controller 218. In an example, the route may be a rail of a track where power may be applied to each rail and a relay coil that may be wired across the rails. Current then energizes the relay coil until the rail vehicle is present such that the axle of the rail vehicle shunts the relay coil. This shunted relay coil is detected by detection circuitry and a determined signal may then be generated. The current provided and detected may be direct current (DC) or alternating current (AC), and the detection circuitry may be matched accordingly. In one example, DC coded track circuits may be provided that modulate current from a power source to the relay to provide output signals received along the track.

To code a signal, a signal generator applies a coded signal of a determined number of pulses, or pulse rate, at a specified carrier frequency onto the rail. A vehicle such as a locomotive may be equipped with dedicated hardware of the controller to receive the generated signal and convey the information to the crew as well as other systems on board the locomotive. The combination of detected pulse rates and carrier frequencies yield the status of a signal with which the controller of the locomotive must comply. Additionally, multiple coded signals on the same track circuit may be provided by different carrier frequencies for each coded signal. The signals may coexist and none, some, or all can be received by the controller of the locomotive depending on the installed equipment.

In one example, the coded signal is a location coded signal that conveys identifying information unique to the first route, or finite portion of the track. When used herein, unique refers to a signal that has characteristics that are different than other signals produced along other routes in a specific transportation system or transportation area. Therefore, in one example, there may be 100,000 individual route sections total in a transportation system or area within the western United States, where each individual section has its own combination of frequency and pulse rate. Thus, each section has a unique signal, because no two signals have the same frequency and pulse rate. Still, the same combination of frequency and pulse rate may be used to identify a track in the Eastern United States. Specifically, a GPS, route data, or otherwise may be used to identify the track system or area of a vehicle, and the unique signal may be used to identify the track in that system or area. The location coded signal includes a combination of pulse counts, or pulse rate, and carrier frequency that may be indicated on a mapped track database associated with first route.

The controller may include one or more processors that may use a look-up table, mathematical equation, algorithm, function, etc. to determine the location of the vehicle based on the pulse count and carrier frequency of the location coded signal. In one example, the controller compares the location coded signal to signals within loaded track database files. Specifically, the track database files may include each track segment of a transportation system, along with the location coded signal associated with each such track segment.

The controller may also include a GPS system, and the determined location may be compared to the location determined by the GPS system. In this manner a verification may be provided for the GPS system. If the location determined by the GPS system, and determined from the location coded signal do not match, the controller may indicate a match is not presented. To this end the controller may display both locations, provide a difference in locations, or the like, to convey information to a driver of the discrepancy. In another example, the discrepancy may be recorded, and/or the GPS location determination may be ignored by the controller in making determinations related to location.

The second route may include a second route circuit (FIG. 3). The second route circuit similar to the first route circuit may include electrical components to provide a second coded location signal 222 that may be received by a vehicle controller. The second coded location signal may be unique and different than the first coded location signal. The signal may be different as a result of the signal generator for the second route providing a different pulse rate, providing a different carrier frequency, a combination thereof, etc. The controller based on the second location coded signal may determine that the vehicle in now on the second route instead of the first route based on the differences in the signal. The controller may also display this information to the driver of the vehicle.

Similarly, the third route may include a third route circuit (FIG. 3). The third route circuit similar to the first route circuit may include electrical components to provide a third coded location signal 226 that may be received by a vehicle controller. The third coded location signal may be unique and different than the first coded location signal and second coded location signal. The third coded location signal may be different as a result of the signal generator for the third route providing a different pulse rate, providing a different carrier frequency, a combination thereof, etc.

The controller based on the third location coded signal, may determine that the vehicle in now on the third route instead of the first route based on the differences in the signal. The controller may also display this information to the driver of the vehicle. In an embodiment where a first route transitions into either a second route or third route depending on the position of a switch, based on the changing of the received signal from the first coded location signal to either the second coded location signal or third coded location signal, the position of the switch may be determined. The switch position may then be communicated to a remote device, such as a controller of another vehicle or a dispatch.

FIG. 3 illustrates a control system 300 that includes a controller 302 configured to receive location coded signals from a route such as a track. In one example, the controller is the controller of one of FIG. 1 or 2. The controller 302 may include one or more processors 304, a storage device 306 such as a memory, a transceiver 308 for receiving and communicating signals, and a display 310. The one or more processors may communicate with a signal detection device 312 and the storage device to make determinations related to a coded location signal.

A route circuit 314 coupled to the route may be affected by a vehicle to generate a determined signal back to the controller. The route circuit of FIG. 3 may be any of the first, second, or third route circuits described in relation to FIG. 2. The route circuit includes a relay 316 that may be electrically coupled to the route, and in one example to the tracks. The relay may be electrically coupled to signal generation circuitry 318 of the route circuit such that when a vehicle is detected by the relay on the route, the signal generation circuitry generates a determined coded signal that may be received by the signal detection device of the controller.

The determined coded signal may be a coded location signal, or an auxiliary coded signal. The coded location signal may be provided a first frequency, such as 100 Hz with a first determined amount of pulse rates, such as 75 pulses, while the auxiliary coded signal may be at a second frequency, such as 200 Hz and or a second determined pulse rate, such as 50 pulses. The coded location signal may be associated with a specific location of a route, while the auxiliary coded signal may be associated with an operating status of the vehicle such as vehicle speed, vehicle movement, or the like. In this manner, information related to the vehicle may be passed from the signal generation circuitry to the controller.

As an example, the one or more processors may receive the coded location signal from the signal detection device and determine the frequency and pulse rates of the coded location signal. Based on the frequency and pulse rate, the one or more processors may determine the location of the vehicle. For example, the storage device may include a look-up table that has frequency and pulse rate pairs that have an associated location or route associated therewith. The one or more processors may then compare the frequency and pulse rate of the coded location signal received to the frequency and pulse rate pairs in the look-up table, and when a match occurs, the associated route or location on a map is the determined location. Alternatively, the one or more processor may use an algorithm, mathematical function or calculation, or the like to determine the location on a map.

In one example, a look-up table may be used to determine when a vehicle begins traveling in a determined section of a route, and that parameter may be used in an algorithm or mathematical function or calculation to determine an instantaneous location of the vehicle. Additional parameters may be used in the algorithm or mathematical function or calculation including vehicle speed, axle rotation, wind speed and direction, GPS location information, vehicle weight, fuel consumption, etc.

The controller may also display the determined output on the display. The display may be an output screen, touch screen, monitor, interface, or the like. In particular, upon determining the location of the vehicle, the location information may be displayed to a driver or crew for use during operation.

In one example, the one or more processors determine the location of the vehicle based on both a coded location signal and a GPS signal. When the coded location signal and GPS signal match, the display may indicate a match, flash, or the like to provide additional confidence to the driver of the location of the vehicle. When the coded location signal and GPS signal result in location that do not match, the one or more processors may provide both on the screen and an indication that they do not match. The indication that the locations do not match may be illustrated by a different color, flashing, a sound or alarm, or the like.

In one example, the difference between the coded location signal location and GPS signal location must be at least a determined distance before the difference is displayed. In one example, the distance is ten meters, such that once the difference in locations is greater than ten meters, the display screen will show the two distances, flash, audibly warn a driver, etc. Under ten meters, no change will be made. While in one example this distance may be 10 meters, in another example the distance may be 20 meters, 5 meters, less than 5 meters, greater than 20 meters, etc. In another example, when both a GPS signal location and coded location signal location are both being received and determined, the one or more processors only use, and display information related to the coded location signal. In this manner, the GPS signal location is only used when a coded location signal is not received.

Figure 4:
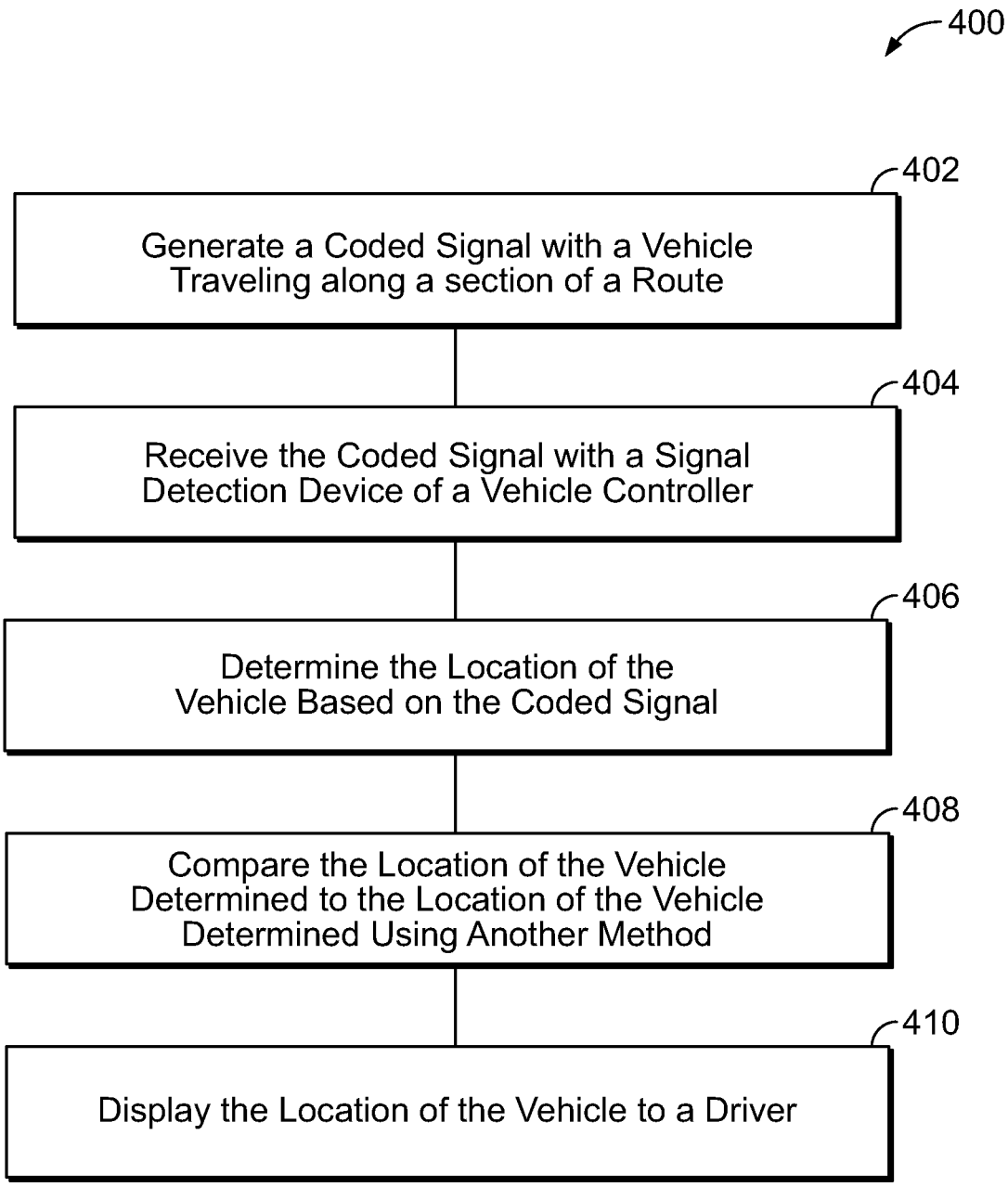
FIG. 4 illustrates a schematic block diagram of a process of communicating location information to a vehicle controller.

FIG. 4 illustrates a method 400 of communicating location information to a vehicle controller. In one example the vehicle controller is one of the controllers of any of the previous figures. The method may be implemented, or partially performed by route circuitry including a power source, a relay, and signal generation circuitry to determine when a vehicle is located at a unique section or portion of a track. The method may also be implemented or partially performed by the vehicle controller, including one or more processors of a vehicle controller, a signal detection device of a vehicle controller, and/or a display of a vehicle controller.

At 402, a coded signal is generated by a vehicle traveling along a unique section of a route. In one example, the vehicle is a rail vehicle traveling on tracks that receive either an AC input or DC input from a power source. A relay may be provided such that when a vehicle passes over the relay, the axles of the vehicle disrupt the relay. Based on the disruption, signal generation circuitry generates a coded signal that may include a determined frequency and/or input pulses.

At 404, the coded signal is received by a signal detection device of a vehicle controller. In one example the signal detection device is associated with the route, or tracks to detect the signal. In this manner, the vehicle itself does not need to move for the signal to be received by the signal detection device. Specifically, the presence of the vehicle on the route, whether moving, or stationary, results in an impact on the relay, causing the coded signal to be generated and consequently received by the vehicle controller. This is an advantage over wayside based sensors that only detect the movement of a vehicle along a route. Thus, in a situation where a vehicle is stopped in a tunnel where a GPS signal may not be reached, and the vehicle is not moving, the vehicle may still be detected, including a known location. This information may then be communicated to remote devices so that the presence of the vehicle is known by remote devices.

At 406, the location of the vehicle is determined based on the coded signal. In one example, the one or more processors of the vehicle controller may use a look-up table, algorithm, mathematical function or calculation, etc. to determine the exact location of the vehicle based on the coded signal. The one or more processor may use a look up table, algorithm, equation, etc. stored in a storage device. To this end, the storage device may include a map with a specific map location based on the coded signal. The map, look-up table, algorithm, equation, or the like may be updated from time to time to better reflect location information as maps, codes, equations, etc. are updated and refined.

At 408, optionally, the location of the vehicle determined may be compared to the location of the vehicle determined using another method. In one example, a GPS signal may be used to determine the location of the vehicle. In particular, when the location of the vehicle based on the GPS signal matches, or closely matches the location based on the coded location signal, verification is provided. Such verification provides increased confidence and reduces mistakes related to location based decisions of a driver.

At 410, the location of the vehicle is displayed to a driver. In one example, when the location based on the coded location signal and a GPS signal vary, such differences may be displayed. The vehicle location may be displayed as a latitude and longitude, mile marker, graphical representation of a vehicle along a route, or the like to convey the information in an understandable manner to the driver. Thus, not only is the location determined, but may also be used by the driver in making driving decisions related to the vehicle along a route.

Thus, a system and method are provided to communicate information from a vehicle system to a remote device using the route itself as a communication pathway. In this manner, when over the air communication methods are not effective as a result of a vehicle being underground, in a remote location without network support, or the like, a communication signal may still be provided to a driver and/or third party related to the location of the vehicle. Such alternative communication path reduces driver error resulting form not knowing where a vehicle is located, and increases safety within a transportation system.

In one or more embodiments, a system may be provided that may include a first route circuit configured to be coupled with a first route section and configured to generate a first location coded signal that is unique to the first route section responsive to a vehicle being located on or within the first route section. The system may also include a second route circuit configured to be coupled with a second route section and configured to generate a second location coded signal that is unique to the second route section and that is different from the first location coded signal, the second route circuit configured to generate the second location coded signal responsive to the vehicle being located on or within the second route section. The system may also have a controller configured to receive the first location coded signal and the second location coded signal and determine a location of the vehicle based on the first location coded signal or the second location coded signal.

Optionally, the first location coded signal may have a first current pulse rate and the second location coded signal may have a second current pulse rate that is different than the first current pulse rate.

Optionally, the system may also include a third route circuit configured to be coupled with a third route section and configured to generate a third location coded signal that is unique to the third route section and that is different from the first location coded signal. The third route circuit may be configured to generate the third location coded signal responsive to the vehicle being located on or within the third route section.

Optionally, the controller may be configured to determine when the vehicle moves from the first route section to one of the second route section or third route section based on receiving either the second location coded signal or the third location coded signal.

Optionally, the controller may be configured to determine a position of a switch coupled to the second route section and third route section based on receiving either the second location coded signal or the third location coded signal.

Optionally, the first route circuit may be configured to generate an auxiliary coded signal based on an auxiliary function that is different than the first location coded signal.

Optionally the first location coded signal may have a first frequency and the auxiliary coded signal may have a second frequency that may be different than the first frequency.

Optionally, the first frequency may be related to a location of the first route section, and the second frequency may be related to an operating status of the vehicle.

Optionally, the controller may be configured to receive location information from a remote device and to determine the location of the vehicle based on a comparison of the location information received and the first location coded signal or the second location coded signal.

Optionally, the controller may be configured to ignore the location information received based on the first location coded signal or the second location coded signal.

In one or more embodiments, a controller may be provided that may include one or more processors that may be configured to receive a first location coded signal from a first route circuit when a vehicle is on a first route section. The first location coded signal may be unique to the first route section. The one or more processors may also be configured to receive a second location coded signal from a second route circuit when the vehicle is on a second route section, the second location coded signal unique to the second route section, and determine a location of the vehicle based on the first location coded signal or on the second location coded signal.

Optionally, the one or more processors may be configured to receive a third location coded signal from a third route circuit when the vehicle is on a third route section, the third location coded signal unique to the third route section, and determine the location of the vehicle based on the third location coded signal.

Optionally, the one or more processors may be configured to determine when the vehicle moves from the first route section to one of the second route section or third route section based on receiving either the second location coded signal or the third location coded signal.

Optionally, the one or more processors may be configured to determine a position of a switch related with the first route section based on receiving either the second location coded signal or the third location coded signal.

Optionally, the one or more processors may be configured to receive an auxiliary coded signal based on an auxiliary function that may be different than the first location coded signal.

Optionally, the first location coded signal may have a first frequency and the auxiliary coded signal may have a second frequency that may be different than the first frequency; and wherein the first frequency may be related to a location of the first route section, and the second frequency may be related to an operating status of the vehicle.

Optionally, the one or more processors may be configured to receive location information from a remote device and to determine the location of the vehicle based on a comparison of the location information received and the first location coded signal or the second location coded signal, and the one or more processors may also be configured to ignore the location information received based on the first location coded signal or the second location coded signal.

In one or more embodiments a system may be provided that may include a first route circuit that may be configured to be coupled with a first route section and configured to generate a first location coded signal that is unique to the first route section responsive to a vehicle being located on or within the first route section. The system may also include a second route circuit that may be configured to be coupled with a second route section and configured to generate a second location coded signal that is unique to the second route section and that is different from the first location coded signal, the second route circuit configured to generate the second location coded signal responsive to the vehicle being located on or within the second route section. The system may also include a third route circuit that may be configured to be coupled with a third route section and may also be configured to generate a third location coded signal that may be unique to the third route section and that may be different from the first location coded signal. The third route circuit may also be configured to generate the third location coded signal responsive to the vehicle being located on or within the third route section. The system may also include a controller that may be configured to receive the first location coded signal, the second location coded signal, and the third location coded signal and determine a position of a switch adjacent the first route section based on at least one of the first location coded signal, the second location coded signal, or the third location coded signal.

Optionally, the controller may be configured to communicate the position of the switch determined to a remote device.

Optionally the first route section may be a first track section, the second route section may be a second track section, and the third route section may be a third track section.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory.

The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a first route circuit configured to be electrically coupled with a first route section, the first route circuit including first signal generation circuitry configured to apply a first location coded signal that is unique to the first route section onto the first route section;

a second route circuit configured to be electrically coupled with a second route section, the second route circuit including second signal generation circuitry configured to apply a second location coded signal that is unique to the second route section onto the second route section;

a signal detection device configured to be disposed onboard a vehicle, the signal detection device configured to detect the first location coded signal on the first route section while the vehicle is on or within the first route section and configured to detect the second location coded signal on the second route section while the vehicle is on or within the second route section; and one or more processors configured to determine a location of the vehicle based on the signal detection device detecting at least one of the first location coded signal or the second location coded signal.

2. The system of claim 1, wherein the first location coded signal has a first current pulse rate and the second location coded signal has a second current pulse rate that is different than the first current pulse rate.

3. The system of claim 1, wherein the one or more processors are configured to determine the location of the vehicle based on detecting a change from the signal detection device detecting the first location coded signal to the signal detection device detecting the second location coded signal.

4. The system of claim 1, wherein the first route section splits into the second route section and a third route section at an intersection, and the one or more processors are configured to determine a position of a switch at the intersection based on the signal detection device detecting either the second location coded signal or a third location coded signal that is unique to the third route section.

5. The system of claim 1, wherein the first route circuit is configured to generate an auxiliary coded signal based on an auxiliary function that is different than the first location coded signal.

6. The system of claim 5, wherein the first location coded signal has a first frequency and the auxiliary coded signal has a second frequency that is different than the first frequency.

7. The system of claim 6, wherein the first location coded signal identifies the first route section, and the auxiliary coded signal indicates an operating status of the vehicle.

8. The system of claim 1, wherein the one or more processors are configured to receive location information from a remote device and to determine the location of the vehicle based on a comparison between the location information that is received and the at least one of the first location coded signal or the second location coded signal detected by the signal detection device.

9. The system of claim 1, wherein the first signal generation circuitry is configured to apply a first location coded signal onto a rail of the first route section, and the signal detection device is configured to detect the first location coded signal on the rail of the first route section as the vehicle is on or within the first route section.

10. The system of claim 1, wherein the first route circuit is configured to detect the vehicle being on or within the first route section, and the first signal generation circuitry is configured to apply the first location coded signal onto the first route section in response to the first route circuit detecting the vehicle on or within the first route section.

11. The system of claim 1, wherein the first route circuit includes a relay that is electrically coupled to the first route section and to the first signal generation circuitry, the first signal generation circuitry configured to apply the first location coded signal onto the first route section in response to the vehicle electrically disrupting the relay.

12. A controller comprising:

a signal detection device configured to be disposed onboard a vehicle and configured to monitor a rail of a route on which the vehicle travels, the signal detection device configured to detect a first location coded signal on the rail while the vehicle is on a first route section of the route and a second location coded signal on the rail while the vehicle is on a second route section of the route, the first location coded signal unique to the first route section, the second location coded signal unique to the second route section; and one or more processors communicatively connected to the signal detection device and configured to determine a location of the vehicle based on the signal detection device detecting at least one of the first location coded signal or the second location coded signal.

13. The controller of claim 12, wherein the one or more processors are configured to determine the location of the vehicle based on detecting a change from the signal detection device detecting the first location coded signal to the signal detection device detecting the second location coded signal.

14. The controller of claim 12, wherein the first route section splits into the second route section and a third route section at an intersection, and the one or more processors are configured to determine a position of a switch at the intersection based on the signal detection device detecting either the second location coded signal or a third location coded signal that is unique to the third route section.

15. The controller of claim 12, wherein the signal detection device is configured to detect an auxiliary coded signal on the rail, the auxiliary coded signal based on an auxiliary function and having a different frequency than the first location coded signal.

16. The controller of claim 15, wherein the one or more processors are configured to determine an operating status of the vehicle based on the signal detection device detecting the auxiliary coded signal.

17. The controller of claim 12, wherein the one or more processors are configured to receive location information from a remote device and to determine the location of the vehicle based on a comparison between the location information that is received and the at least one of the first location coded signal or the second location coded signal detected by the signal detection device.

18. A system comprising:

a first route circuit configured to be electrically coupled with a first route section, the first route circuit configured to detect a vehicle on or within the first route section and to generate a first location coded signal that is unique to the first route section responsive to detecting the vehicle on or within the first route section;

a second route circuit configured to be electrically coupled with a second route section, the second route circuit configured to detect the vehicle on or within the second route section and to generate a second location coded signal that is unique to the second route section responsive to detecting the vehicle on or within the second route section; and one or more processors configured to receive at least one of the first location coded signal or the second location coded signal and to determine a location of the vehicle based on the at least one of the first location coded signal or the second location coded signal.

19. The system of claim 18, wherein the first route section splits into the second route section and a third route section at an intersection, and the one or more processors are configured to determine a position of a switch at the intersection based on receiving the first location coded signal followed by receiving either the second location coded signal or a third location coded signal that is unique to the third route section.

20. The system of claim 18, wherein the first route circuit includes first signal generation circuitry configured to apply the first location coded signal onto the first route section in response to detecting the vehicle on or within the first route section, the system further comprising a signal detection device configured to be disposed onboard the vehicle and to detect the first location coded signal on the first route section while the vehicle is on or within the first route section.

* * * * *